US011905763B2

(12) United States Patent
Fox

(10) Patent No.: US 11,905,763 B2
(45) Date of Patent: Feb. 20, 2024

(54) DOWNHOLE TRANSMISSION SYSTEM WITH PERFORATED MCEI SEGMENTS

(71) Applicant: Joe Fox, Spanish Fork, UT (US)

(72) Inventor: Joe Fox, Spanish Fork, UT (US)

( * ) Notice: Subject to any disclaimer, the term of this patent is extended or adjusted under 35 U.S.C. 154(b) by 176 days.

(21) Appl. No.: 17/665,533

(22) Filed: Feb. 5, 2022

(65) Prior Publication Data

US 2022/0170327 A1 Jun. 2, 2022

(51) Int. Cl.

| | |
|---|---|
| ***E21B 17/02*** | (2006.01) |
| ***E21B 47/13*** | (2012.01) |
| ***E21B 17/00*** | (2006.01) |

(52) U.S. Cl.

CPC ..... *E21B 17/0285* (2020.05); *E21B 17/003* (2013.01); *E21B 47/13* (2020.05)

(58) Field of Classification Search

CPC ... E21B 47/13; E21B 47/0285; E21B 47/0283
See application file for complete search history.

(56) References Cited

U.S. PATENT DOCUMENTS

| | | | | |
|---|---|---|---|---|
| 8,130,118 | B2 * | 3/2012 | Hall | E21B 17/028 340/855.1 |
| 8,735,743 | B2 * | 5/2014 | Harmon | E21B 17/028 340/854.9 |
| 2006/0174702 | A1 * | 8/2006 | Hall | E21B 47/13 73/152.03 |
| 2008/0074226 | A1 * | 3/2008 | Hall | E21B 17/028 336/96 |

* cited by examiner

*Primary Examiner* — Robert E Fuller

(57) ABSTRACT

A system for transmitting data and power downhole includes an annular groove in a downhole tool such as a drill pipe shoulder or other tool body. A housing for an inductive coupler being disposed within the annular groove. The housing may be a metal ring or a polymeric ring suitable for downhole conditions. An annular MCEI trough may be located within the housing. The MCEI trough may comprise segments. One of the segments may comprise one or more perforations. An electrically conductive coil may be placed in the MCEI trough. The coil may comprise a transmission end and a groundable end. The groundable end may be connected to the tool body by a ground post through the perforations in the MCEI segments and the housing. The transmission end may be connected to a cable within the downhole tool through the other perforation in the MCEI trough and housing.

20 Claims, 13 Drawing Sheets

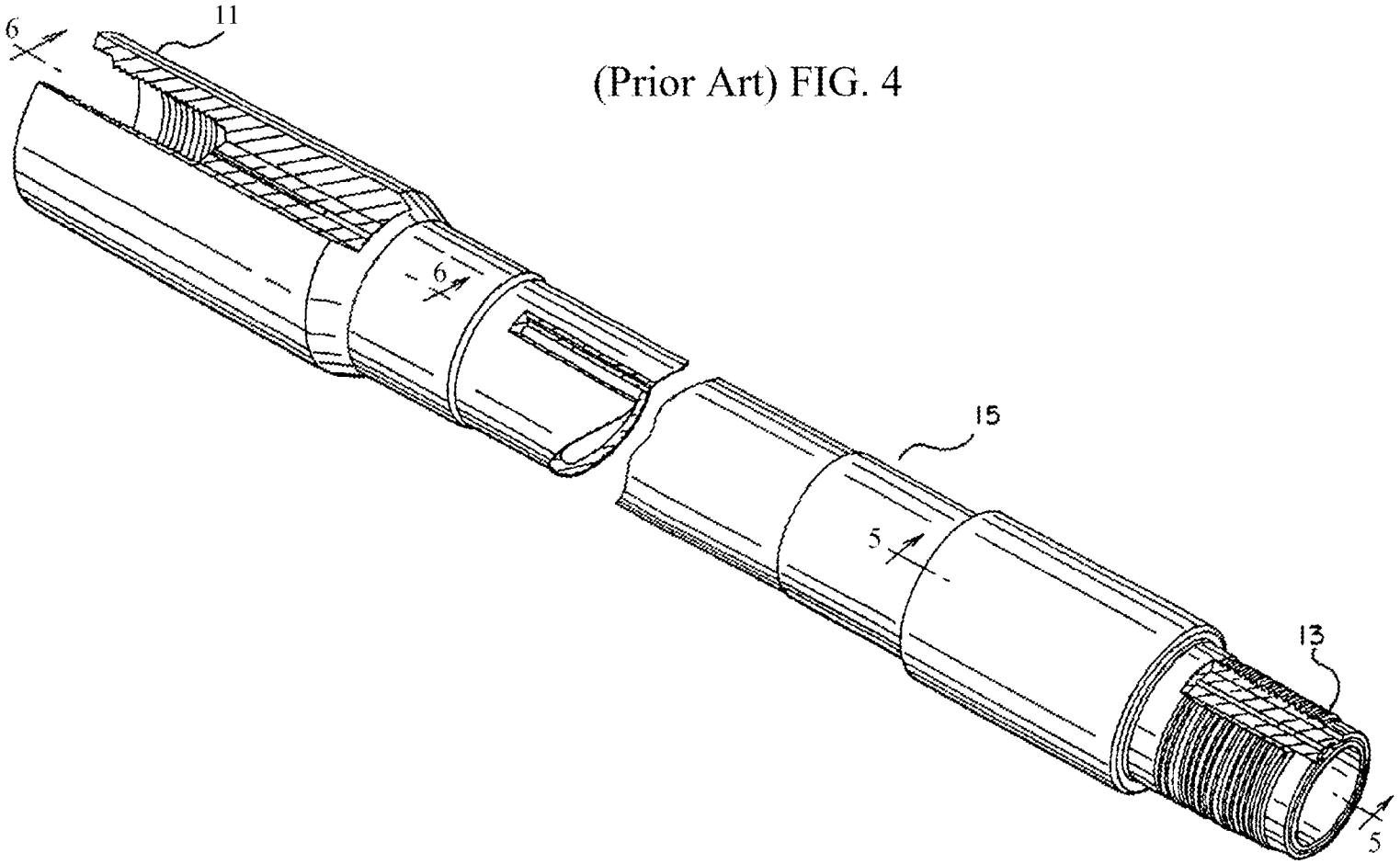
(Prior Art) FIG. 4

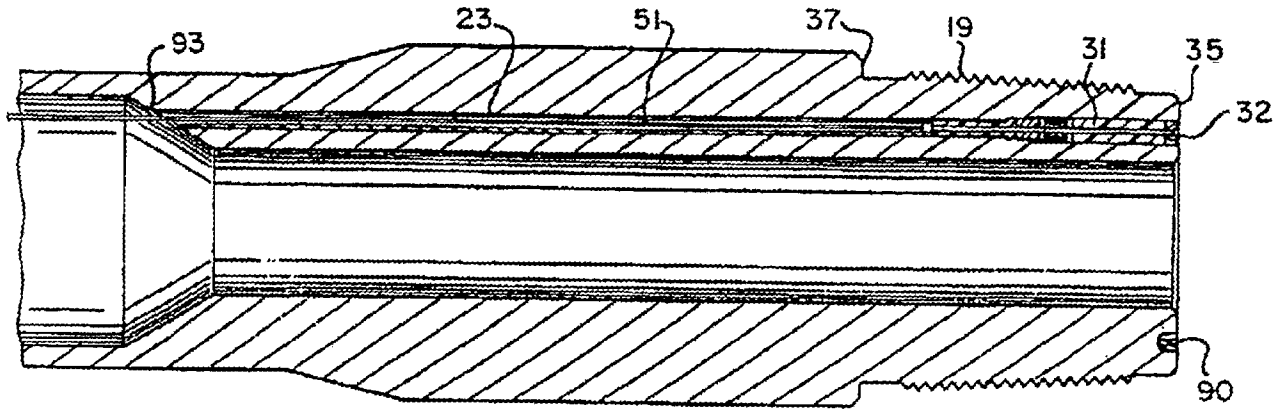
(Prior Art) FIG. 5
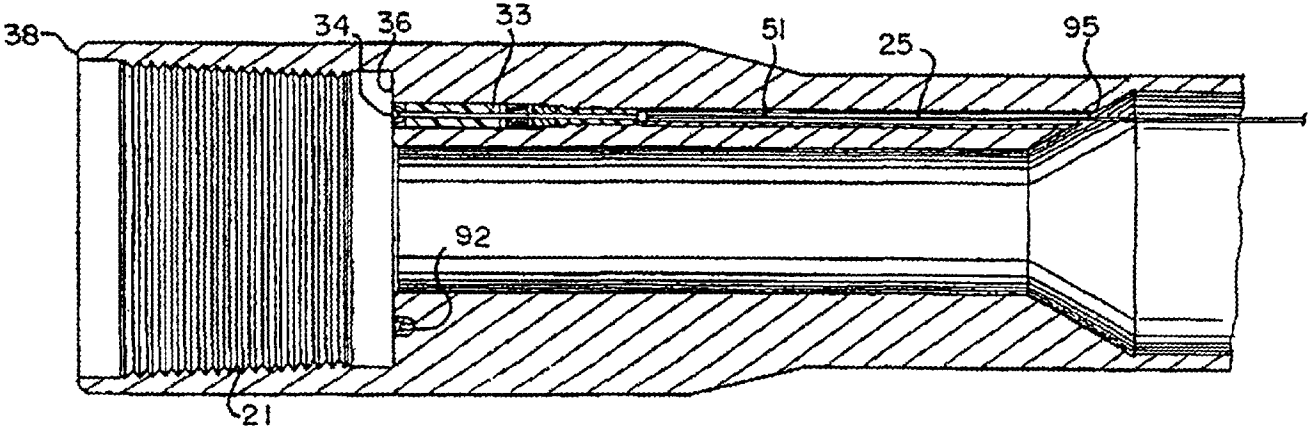
(Prior Art) FIG. 6

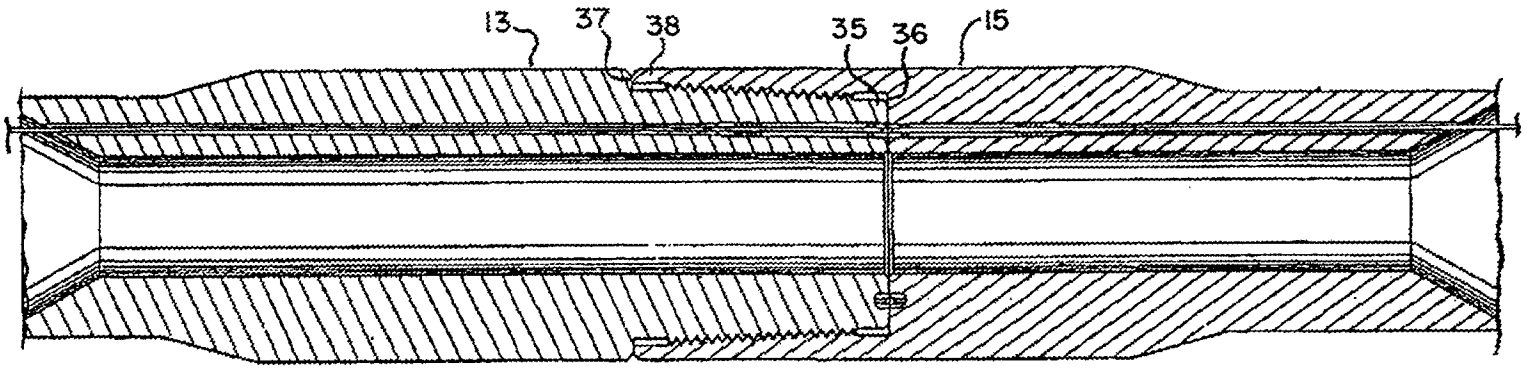
(Prior Art) FIG. 7
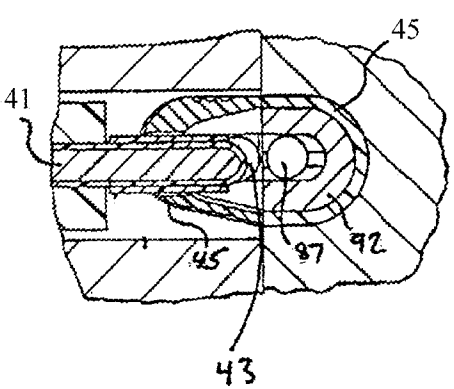
(Prior Art) FIG. 8B
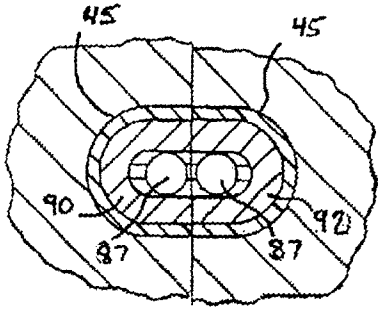
(Prior Art) FIG. 8A
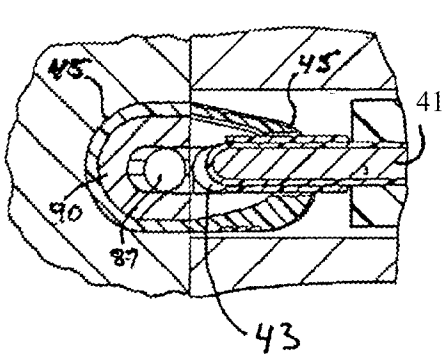
(Prior Art) FIG. 8C

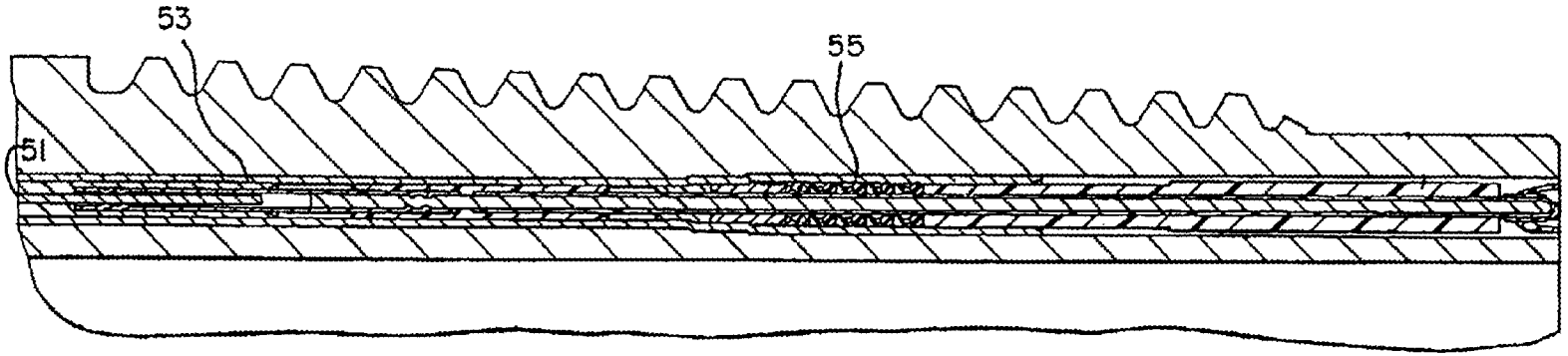
(Prior Art) FIG. 9
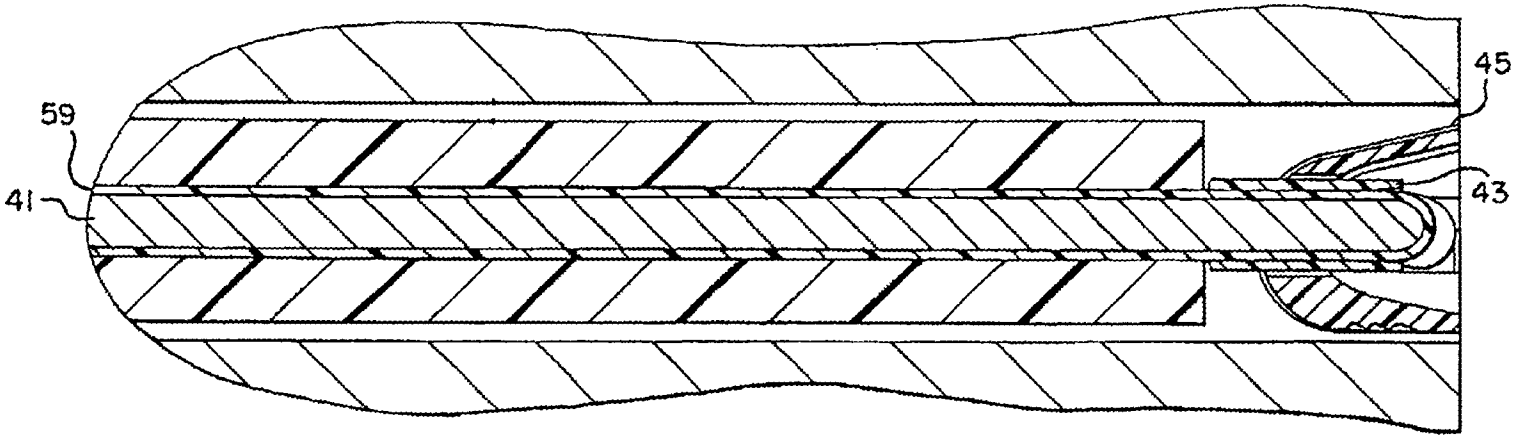
(Prior Art) FIG. 10

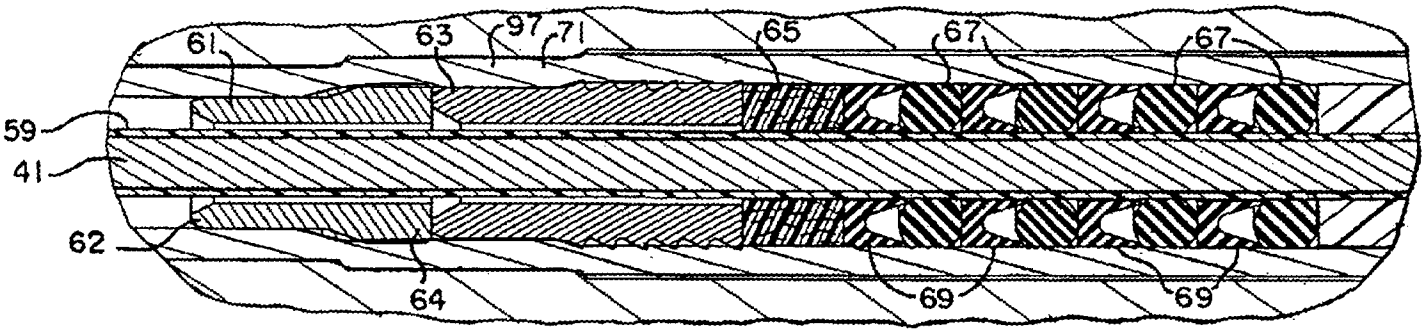
(Prior Art) FIG. 11
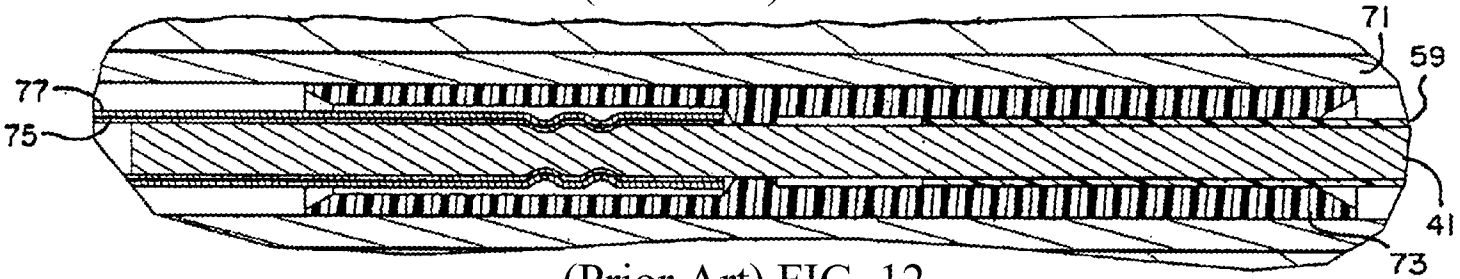
(Prior Art) FIG. 12
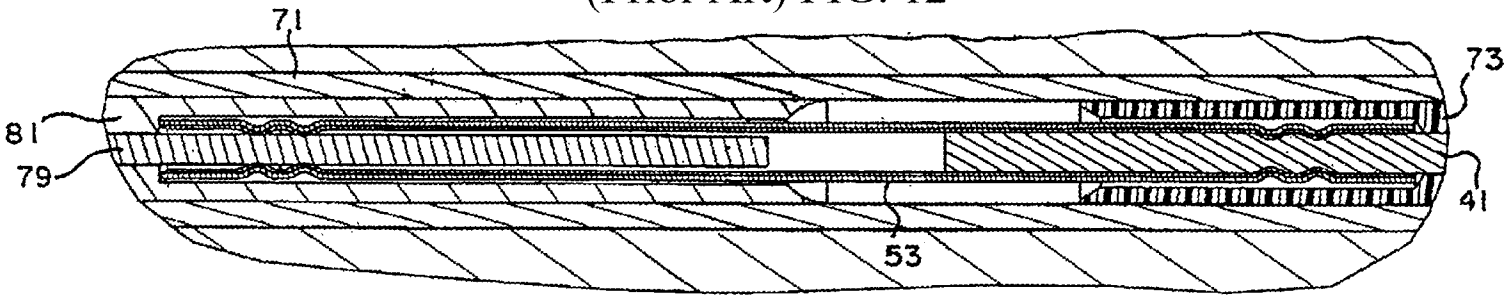
(Prior Art) FIG. 13

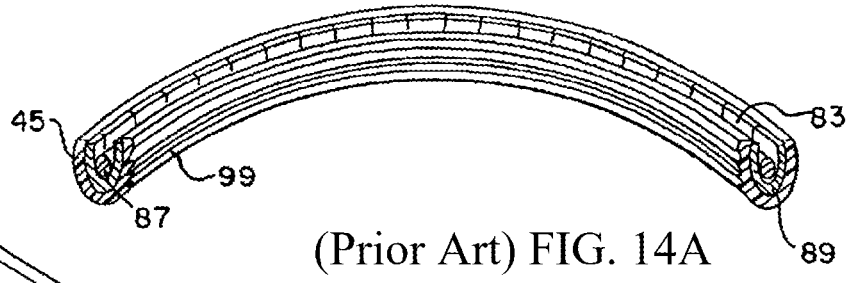
(Prior Art) FIG. 14A
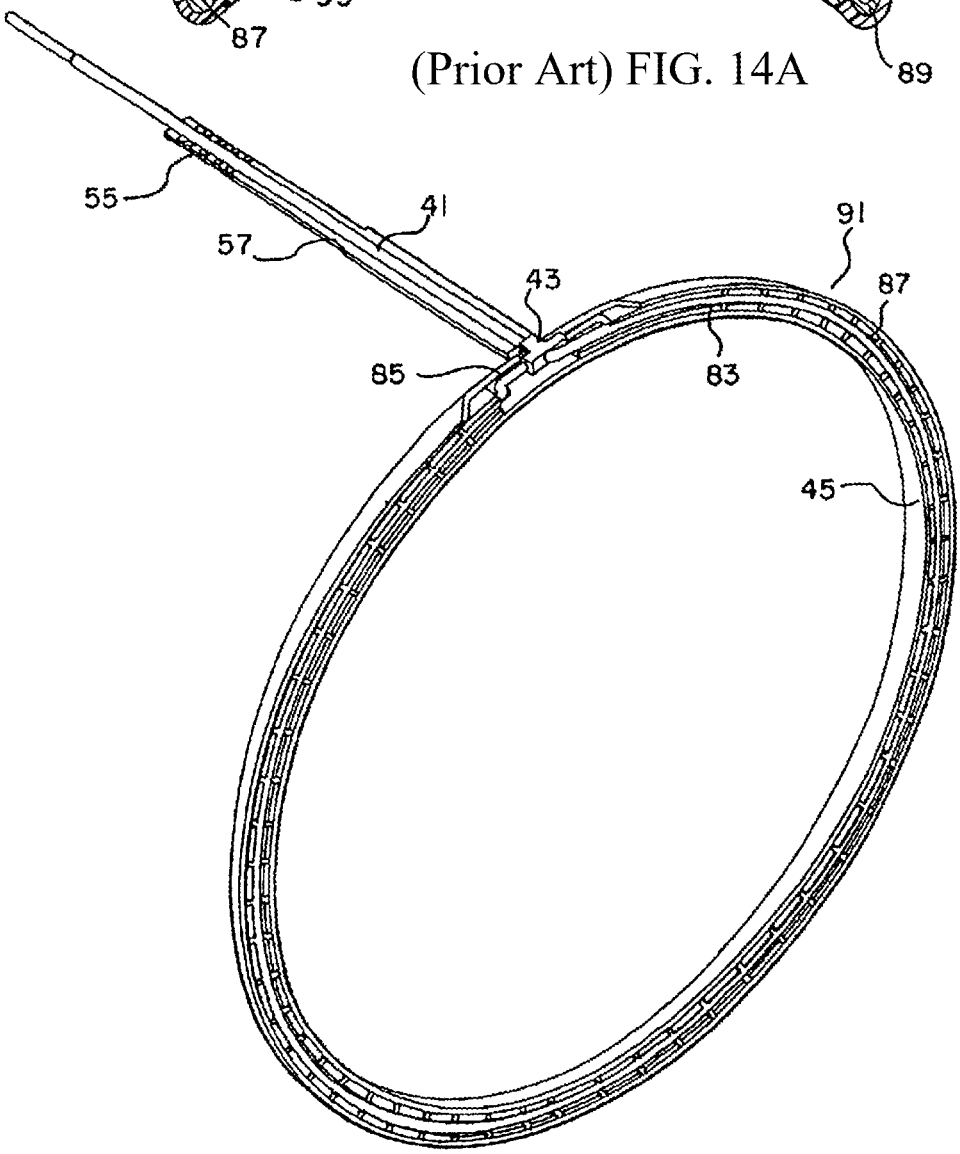
(Prior Art) FIG. 14

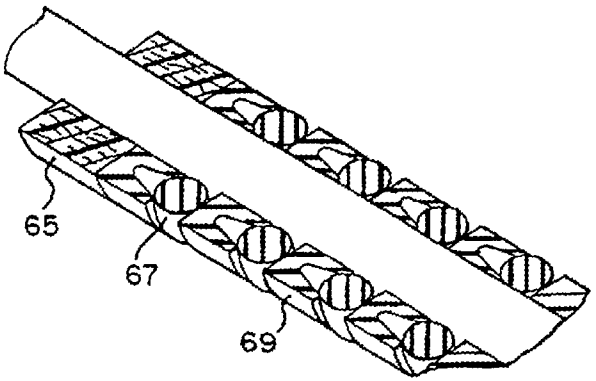
(Prior Art) FIG. 16
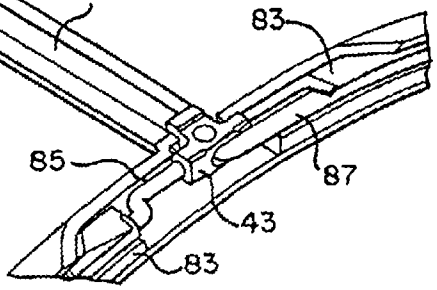
(Prior Art) FIG. 15
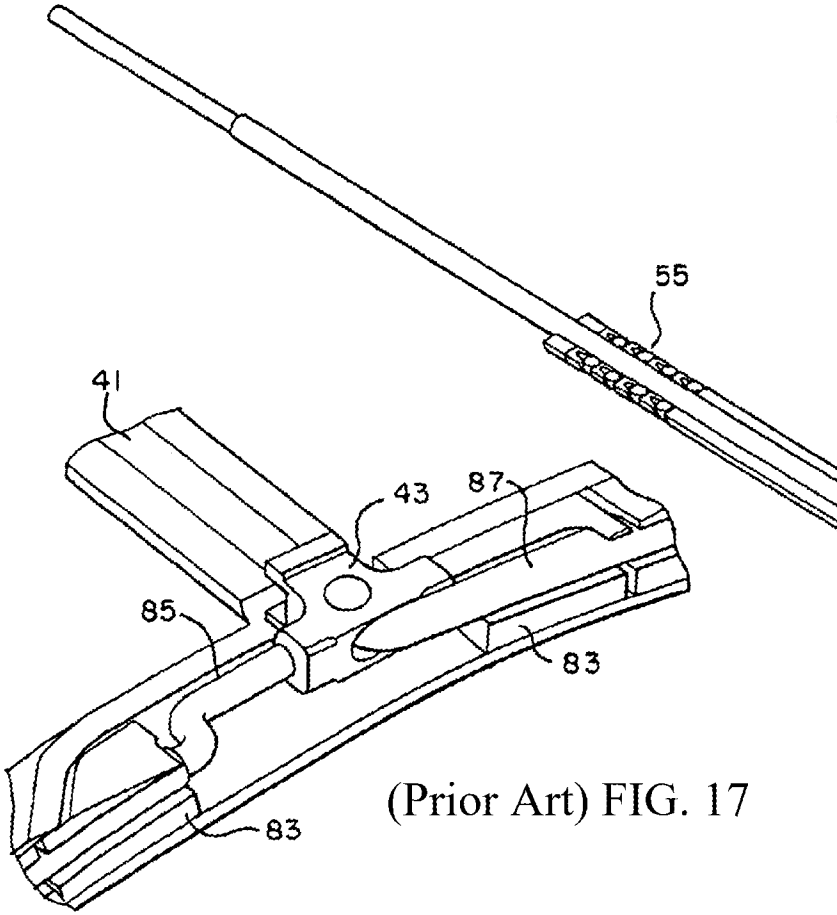
(Prior Art) FIG. 17

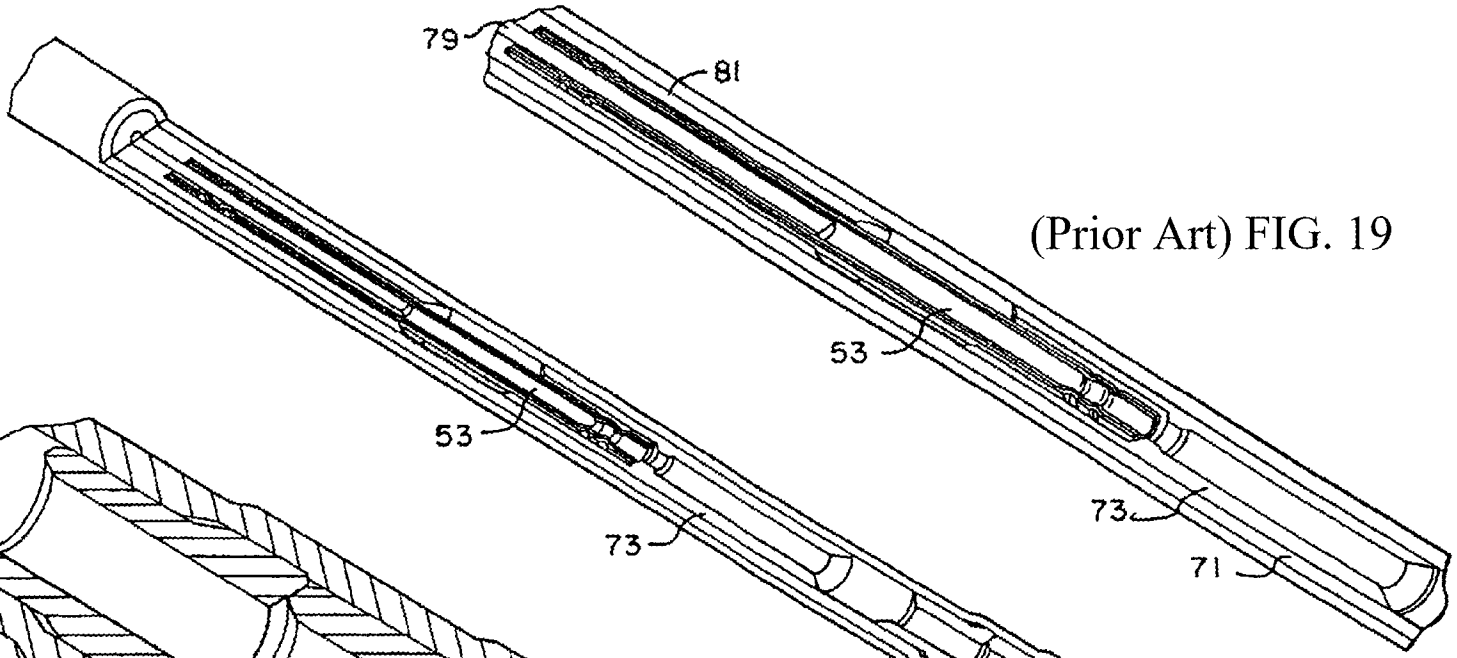
(Prior Art) FIG. 19
(Prior Art) FIG. 18
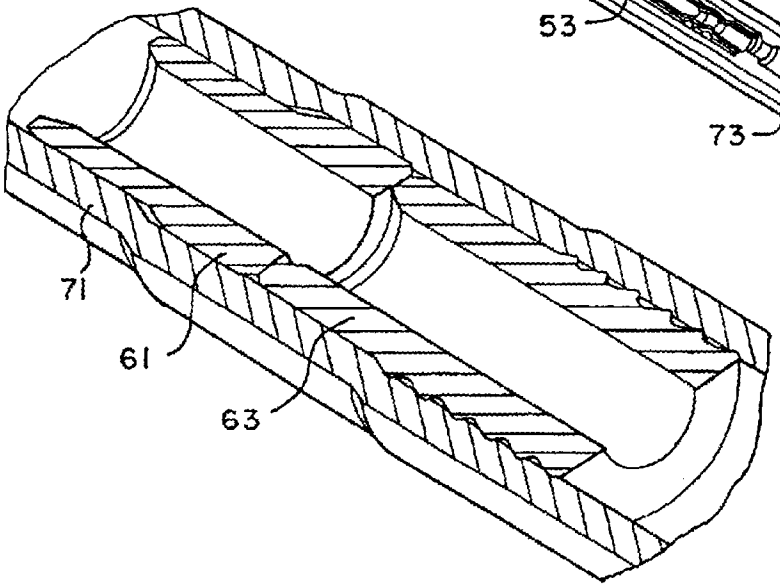
(Prior Art) FIG. 20

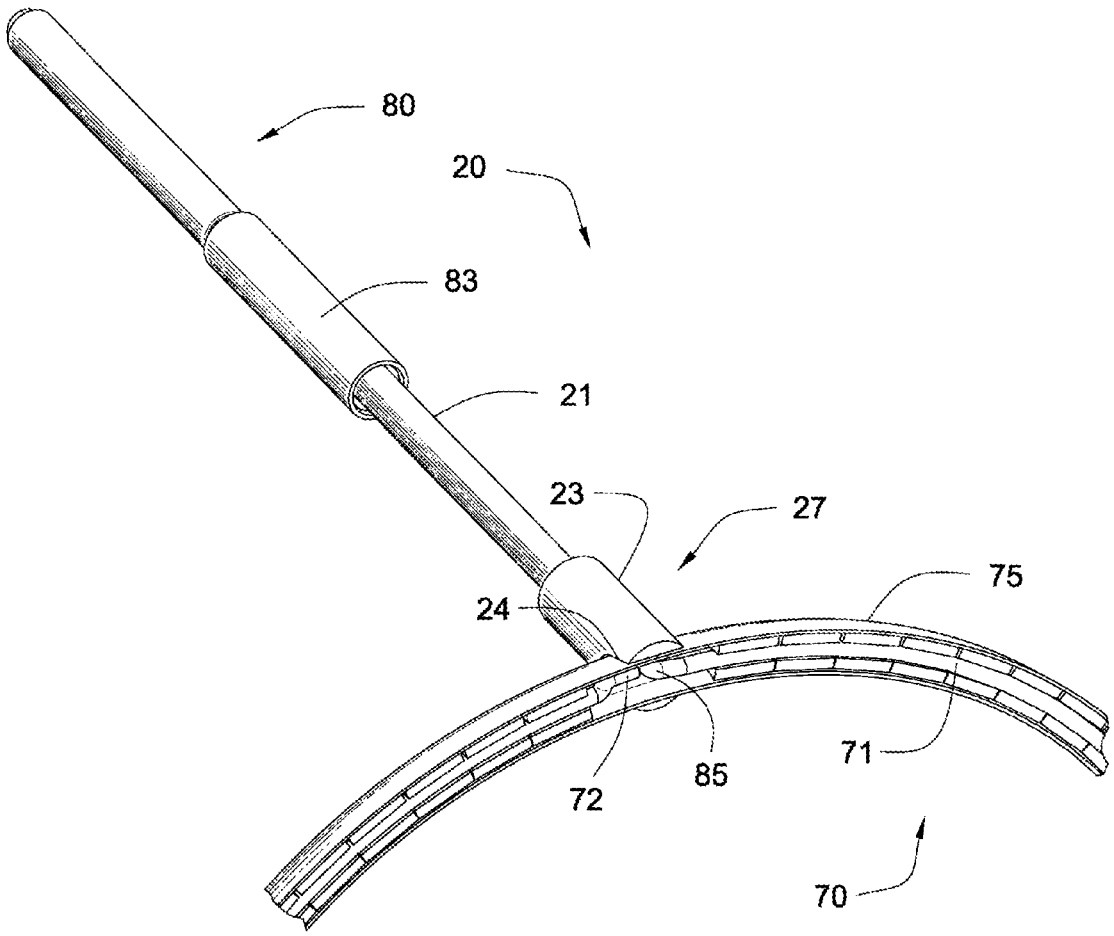
(Prior Art) FIG. 21

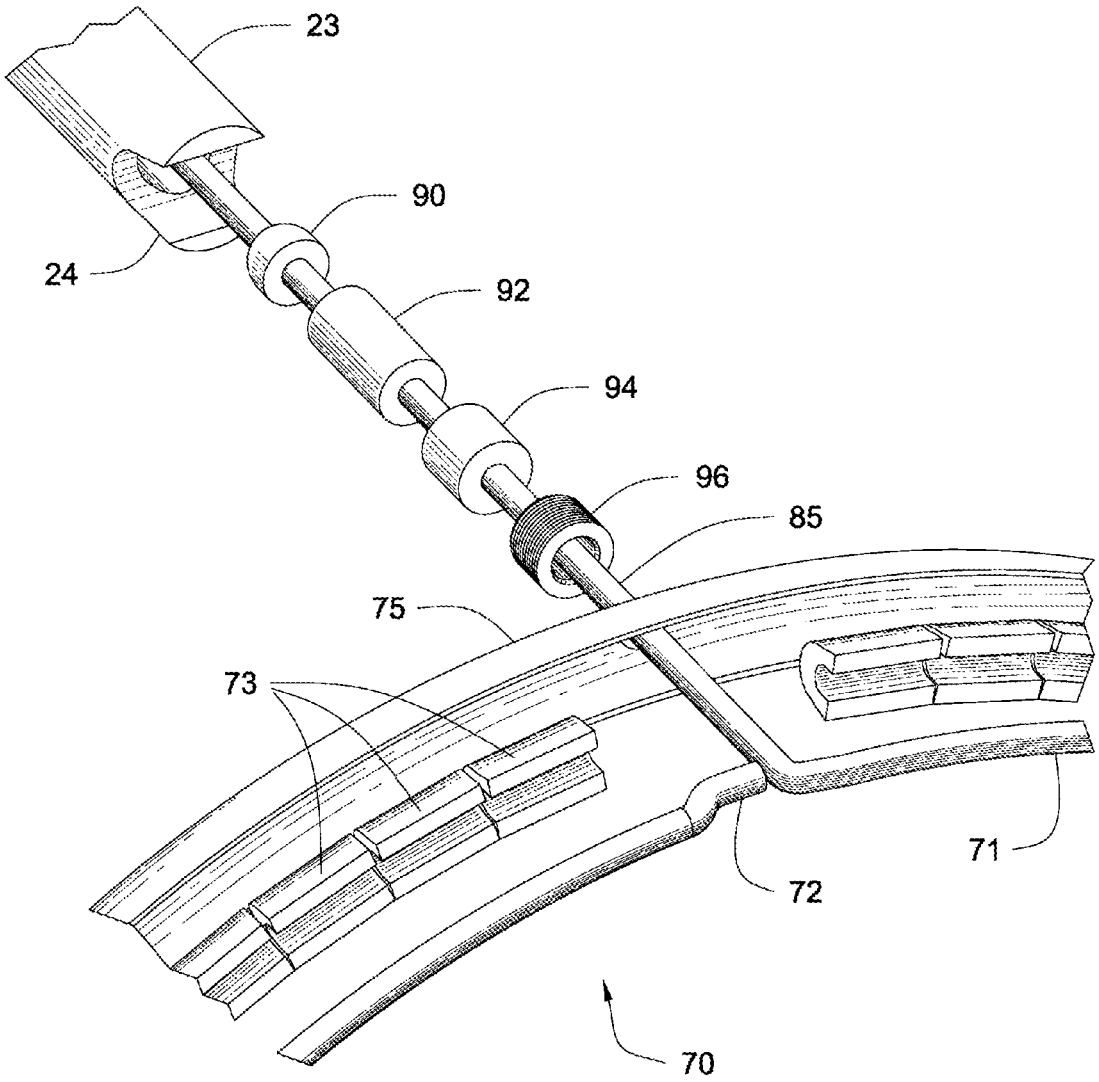
(Prior Art) FIG. 22

DOWNHOLE TRANSMISSION SYSTEM WITH PERFORATED MCEI SEGMENTS

RELATED APPLICATIONS

The present application presents an enhanced modification of U.S. Pat. No. 6,844,498, to Hall et al., entitled Data Transmission System for a Downhole Component, issued Jan. 18, 2005, which is incorporated herein by this reference. The prior art figures and related text are taken from said reference and apply equally to the present application except when modified by this application.

U.S. Pat. No. 11,033,958, to Imaoka et al., entitled Magnetic Material and Manufacturing Method Thereof, issued Jun. 15, 2021, is incorporated herein by this reference.

(Prior Art) FIGS. 21 and 22, and related text herein are taken from U.S. Pat. No. 6,945,802, to Hall et al., entitled Seal for Coaxial Cable in Downhole Tools, issued Sep. 20, 2005. Said reference is incorporated herein by this reference.

BACKGROUND

The present application relates to data and power transmission systems for downhole environments along a drill string used in oil and gas exploration and geothermal well construction. More specifically this application relates to the transmission of data and power between connected drillstring components.

The goal of accessing data from a drill string has been expressed for more than half a century. As exploration and drilling technology has improved, this goal has become more important in the industry for successful oil, gas, and geothermal well exploration and production. For example, to take advantage of the several advances in the design of various tools and techniques for oil and gas exploration, it would be beneficial to have real time data such as temperature, pressure, inclination, salinity, etc. Several attempts have been made to devise a successful system for accessing such drill string data. One such system is disclosed in co-pending U.S. application Ser. No. 09/909,469 (also published as PCT Application WO 02/06716) which is assigned to the same assignee as the present invention. The disclosure of this U.S. application Ser. No. 09/909,469 is incorporated herein by reference.

SUMMARY

A downhole data and power transmission system, comprising a downhole tool such as may be found in a drillstring for drilling oil, gas, and geothermal wells: for example, a drill pipe and other bottom hole assembly drillstring tools. An electromagnetic coupler may be used for the transmission of data and power between connected drill pipes and other downhole tools.

An annular recess or groove may be formed in the body of the downhole tool. In the case of a double shouldered drill pipe, the annular recess or groove may be formed in the secondary shoulders of the box end and the pin end. As may be shown in (Prior Art) FIGS. 5 and 6. Likewise, the annular groove may be formed in a similarly configured shoulder of another component of the drill string. The annular groove may communicate or intersect a drilled opening, passage, or passageway also formed in the body of the downhole tool. The surface of the groove may comprise a hardness on the Rockwell C scale harder than the body of the tool adjacent to the groove. The hardness of the groove's surfaces may be achieved by means of deforming or indenting the surface by peening, including shot peening, laser peening, hammer peening, or brinelling, or a combination thereof.

The coupler may comprise an annular housing, like a steel ring or a polymeric block, that may be disposed within the annular groove. The annular housing may comprise one or more perforations. The perforations may be aligned with the passageway in the annular groove when the housing is installed into the annular groove.

An annular magnetically conductive and electrically insulating (MCEI) trough or channel comprising one or more perforations may be disposed within the annular housing. The MCEI trough may comprise a plurality of segments. For example, a segment may comprise one or two perforations. At least one of the perforations in the MCEI trough may be aligned with one of the perforations in the annular housing, producing a passageway between the MCEI trough and the drilled passageway in the body of the downhole tool.

An annular electrically conductive wire coil may be laid within the annular MCEI trough. The coil may comprise one or more turns. The coil may comprise a linear coil or a nonlinear coil such as a helical coil. The coil may comprise an electrically groundable end and a data or power transmission end. The groundable end may be connected to a ground post installed in the tool body. A ground post may be aligned with a first perforation in the housing and a first perforation in the MCEI trough, thereby electrically grounding the coil to the downhole tool body. The data and power transmission end of the coil may be connected through a second perforation in the annular housing and the second perforation in the MCEI trough to a cable within a downhole tool or a coaxial cable running within the drilled passageway in the downhole tool body. The coaxial cable in the drilled passageway may be connected to a transmission end of an annular coil in a similarly configured annular groove and through a similarly configured annular housing and annular MCEI trough at the opposite end of the downhole tool. The cable may comprise a coaxial cable, a twisted pair of wires, or an insulated conductor. The coaxial cable may comprise an armored cable comprising a stainless steel sheath or tube. The cable may comprise a nonmagnetic or a magnetic stainless steel tube. The cable may be connected to the transmission end of the coil and to equipment within or attached to the downhole tool. Coil's ends may be connected to the cable and the ground post using a compression connector. The coil may be embedded in a nonelectrically conducting filler material in the MCEI trough.

A cylindrical clamp may fix the cable in the drilled passageway proximate the annular groove. The clamp may be a cylindrical clamp comprising a passageway through which the cable may pass. The clamp may comprise a slit. The slit may be a nonlinear slit and may have an opening wider at the distal end of the clamp than at the proximal end of the clamp. The slit may allow the clamp to compress against the inside wall of the drilled passageway and the outside wall of the cable, thereby securing the cable in the passageway. In downhole use, pipes making up a drillstring hung from a drill rig may elongate as the weight of the drillstring increases with length. The cable clamped at both ends of the drill pipe should be capable of tolerating such elongation forces, tension, acting on the drillstring components downhole. The cable's stainless steel tube and the internal components of the cable, the center conductor and dielectric, must also be able tolerate drill pipe elongation or stretch. To counteract such forces, the cable and the internal components may be compressed within the stainless steel tube sufficiently that under normal conditions the compressed condition of the cable permits the cable and its components to stretch or elongate along with the drill pipes in the string. The compressed condition of the c able protects the cable from the elongation forces otherwise acting on each individual drill pipe or other tool making up the drill string. The clamp may be positioned in a tapered portion and on a shoulder within the drilled passageway. As the clamp is positioned in the tapered portion of the drilled passageway, the slit allows the clamp to compress against the tapered wall of the drilled passageway and against the outside wall of the cable. The clamping force thus created should be sufficient to maintain the compressed condition of the cable as the drill string increases in length and drilling continues downhole.

A gasket may seal off the drilled passageway within the downhole tool. The gasket may be located between the clamp and the annular groove in the downhole tool. The gasket may be a reinforced gasket. The reinforced gasket may comprise internal reinforcement such as a helical spring or a leaf spring or other reinforcements. The spring may comprise a metal or a nonmetal sufficiently resilient to contribute additional compressive force to the gasket. The gasket may comprise a passageway through which the cable may pass. The gasket may seal outside wall of the cable against the inside wall of the passageway. The gasket may also seal the outside wall of the gasket against the inside wall of the drilled passageway. Thereby, the gasket may seal off the drilled passageway and the annular groove from the fluids and pressures encountered downhole. The gasket may comprise a material suitable to withstand the harsh conditions downhole. A helical snap ring may be disposed in the drilled passageway between the gasket and the annular groove. The snap ring may fix the gasket in place in the drilled passageway.

The housing may comprise a downhole-suitable polymeric block comprising polyester ether ketone (PEEK), polytetrafluoroethylene (PTFE) (TEFLON), or polyoxymethylene (Delrin), or a combination thereof, comprising up to 67% by volume of micron and submicron particles of Fe and Mn ranging in average diameters of between 150μ and 3000μ in an average ratio of between 8:2 and 2:8, respectively. When electrified, the coupler comprising the annular coil may produce and electromagnetic field in the MCEI trough suitable for transmission of data and power to an adjacent similarly configured coupler comprising a MCEI trough and coil. The MCEI trough may direct the electromagnetic field to the adjacent MCEI trough in connected drill pipes. But the connection is not leakproof, that is a portion of the electromagnetic field surrounding the coil may leak out into the surrounding steel of the drill pipe and stray electromagnetic fields originating in the drill pipe and outside of the drill pipe may interfere with the transmission between couplers. The presence of the Fe and Mn particles in the block may provide an additional barrier preventing the leakage of the electromagnetic field created by the annular coil and preventing electronic and magnetic interference from the surrounding environment thereby increasing the efficiency of the coupling.

The following text is taken from the '498 reference. The descriptions presented herein apply to FIGS. 1-3, except where modified by this disclosure.

In accordance with one aspect of the invention, the system includes a plurality of downhole components, such as sections of pipe in a drill string. Each component has a first and second end, with a first communication element located at the first end and a second communication element located at the second end. Each communication element includes a first contact and a second contact. The system also includes a coaxial cable running between the first and second communication elements, the coaxial cable having a conductive tube and a conductive core within it. The system also includes a first and second connector for connecting the first and second communication elements respectively to the coaxial cable. Each connector includes a conductive sleeve, lying concentrically within the conductive tube, which fits around and makes electrical contact with the conductive core. The conductive sleeve is electrically isolated from the conductive tube. The conductive sleeve of the first connector is in electrical contact with the first contact of the first communication element, the conductive sleeve of the second connector is in electrical contact with the first contact of the second communication element, and the conductive tube is in electrical contact with both the second contact of the first communication element and the second contact of the second communication element.

The first and second communication elements are preferably inductive coils, and the inductive coils are preferably formed by a single loop of wire. More preferably, the inductive coils include at least one loop of wire set in circular trough of a magnetically conducting, electrically insulating material, preferably ferrite. Preferably, the trough is formed of segments of a magnetically conducting electrically insulating material, with the electrically insulating material segments preferably retained within a groove formed in a metal ring.

In accordance with another aspect of the invention, the components are sections of drill pipe, each having a central bore, and the first and second communication elements are located in a first and second recess respectively at each end of the drill pipe. The system further includes a first passage passing between the first recess and the central bore and a second passage passing between the second recess and the central bore. The first and second connectors are located in the first and second passages respectively. Preferably, each section of drill pipe has a portion with an increased wall thickness at both the box end and the pin end with a resultant smaller diameter of the central bore at the box end and pin end, and the first and second passages run through the portions with an increased wall thickness and generally parallel to the longitudinal axis of the drill pipe.

In accordance with another aspect of the invention, the system includes a first and second expansion plug, each of which includes a central passage and each of which is press-fit within the conductive tube so as to maintain the increased outside diameter of the conductive tube within the larger diameter portions of the first and second passages respectively. The system also preferably includes a first and second retaining plug, each of which includes ridges on its outer surface to retain the expansion plugs in place.

In accordance with another aspect of the invention, the first and second communication elements each includes an inductive coil having at least one loop of wire. In each communication element, there is a water-tight seal between the wire and the inside of the conductive tube. The water-tight seal preferably includes at least one gasket through which the first end of the wire passes and which forms a seal with the inner surface of the conductive tube.

The invention also includes a method of electrically connecting communication elements at opposite ends of a downhole component through a coaxial conductor. The method includes providing a coaxial cable as the conductor between the first and second communication elements. The coaxial cable includes a conductive tube, a conductive core within the conductive tube and a dielectric material between the conductive tube and the conductive tube. The method also includes providing a first and second connector for connecting the first and second respective communication elements to the coaxial cable. The first and second connectors each include a conductive sleeve that fits around and makes electrical contact with the conductive core. The conductive sleeve is electrically isolated from the conductive tube. The method also includes removing a portion of the dielectric material at both ends of the coaxial cable to provide clearance for the conductive sleeve, and sliding the first and second connectors over both ends of the coaxial cable.

In accordance with another aspect of the invention, the method includes expanding the outside diameter of the conductive tube by inserting an expansion plug into each end. The first and second communication elements each include an inductive coil having at least one loop of wire. In each communication element, a first end of the wire is in electrical contact with the conductive tube and a second end of the wire is in electrical contact with the conductive sleeve. The method further includes inserting a water-tight seal between the second end of the wire and the inside of the conductive tube.

The present invention, together with attendant objects and advantages, will be best understood with reference to the detailed description below in connection with the attached drawings.

BRIEF DESCRIPTION OF THE DRAWINGS

(Prior Art) FIG. 4 is a perspective view of a section of drill pipe with cutaway sections showing the data transmission system.

(Prior Art) FIG. 5 is a cross-sectional view along line 2-2 of (Prior Art) FIG. 4.

(Prior Art) FIG. 6 is a cross sectional view along line 3-3 of (Prior Art) FIG. 4.

(Prior Art) FIG. 7 is a cross-sectional view showing the pin end of (Prior Art) FIG. 5 connected to the box end of (Prior Art) FIG. 6.

(Prior Art) FIG. 8A is an enlarged cross-section of a connection between communication elements of a connected pin and box end.

(Prior Art) FIG. 8B is an enlarged cross-section of a connection between communication elements of a connected pin and box end, showing the protective bridge on the pin end.

(Prior Art) FIG. 8C is an enlarged cross-section of a connection between communication elements of a connected pin and box end, showing the protective bridge on the box end.

(Prior Art) FIG. 9 is a cross-sectional view of the pin end of a drill pipe showing the connector.

(Prior Art) FIG. 10 is an enlarged cross-sectional view from (Prior Art) FIG. 9 showing the placement of the magnetically connecting, electrically insulating (MCEI) element in the recess of the pin end of a drill pipe.

(Prior Art) FIG. 11 is an enlarged cross-sectional view from (Prior Art) FIG. 9 showing the placement of the expansion plug, retaining plug, and water-tight seal.

(Prior Art) FIG. 12 is an enlarged cross-sectional view from (Prior Art) FIG. 9 showing the placement of the centering guide.

(Prior Art) FIG. 13 is an enlarged cross-sectional view from (Prior Art) FIG. 9 showing the connector and the end of the coaxial cable.

(Prior Art) FIG. 14 is a perspective view of the communication element and steel ring.

(Prior Art) FIG. 14A is a perspective view showing a cross section of the communication element.

(Prior Art) FIG. 15 is perspective view of the wire and the wire protection bridge.

(Prior Art) FIG. 16 is an enlarged perspective view showing the water-tight seal.

(Prior Art) FIG. 17 is an enlarged perspective view of (Prior Art) FIG. 15 showing the wire protection bridge.

(Prior Art) FIG. 18 is a perspective view of the conductive tube and connection elements.

(Prior Art) FIG. 19 is an enlarged perspective view of (Prior Art) FIG. 18 showing the centering guide and the connector.

(Prior Art) FIG. 20 is an enlarged perspective view of (Prior Art) FIG. 18 showing the expansion plug and the retaining plug.

(Prior Art) FIG. 21 is taken from the '802 reference and depicts elements of a transmission coupler.

(Prior Art) FIG. 22 is taken from the '892 reference and depicts elements of a transmission line seal.

DETAILED DESCRIPTION OF THE INVENTION

A downhole data and power transmission system, comprising a downhole tool such as may be found in a drillstring for drilling oil, gas, and geothermal wells: for example, a drill pipe and other bottom hole assembly drillstring tools. An electromagnetic coupler as shown in FIGS. 1-3 may be used for the transmission of data and power between connected drill pipes and other downhole tools.

An annular recess or groove 290 may be formed in the body of the downhole tool 253. In the case of a double shouldered drill pipe, the annular recess or groove 290 may be formed in the secondary shoulders of the box end and the pin end. As may be shown in (Prior Art) FIGS. 5 and 6. Likewise, the annular groove 290 may be formed in a similarly configured shoulder of another component of the drill string. The annular groove 290 may communicate or intersect a drilled opening, passage, or passageway 250 also formed in the body 253 of the downhole tool. The surface of the annular groove 290 may comprise a hardness on the Rockwell C scale harder than the body 253 of the tool adjacent to the groove 290. The hardness of the groove's surfaces may be achieved by means of deforming or indenting the surface by peening, including shot peening, laser peening, hammer peening, or brinelling, or a combination thereof.

Figure 1:
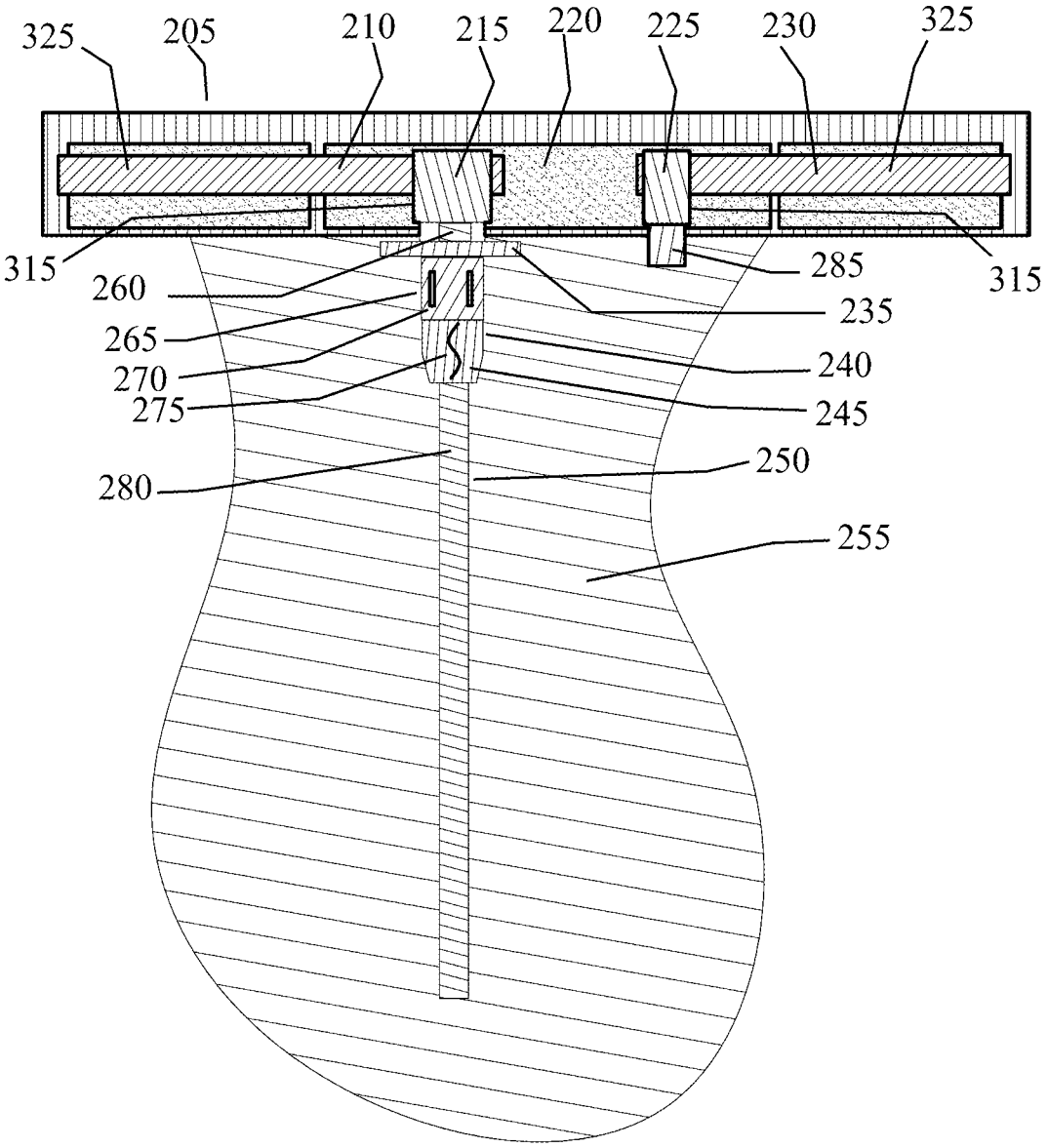
FIG. 1 is a diagram including the modifications presented in this application.
Figure 2:
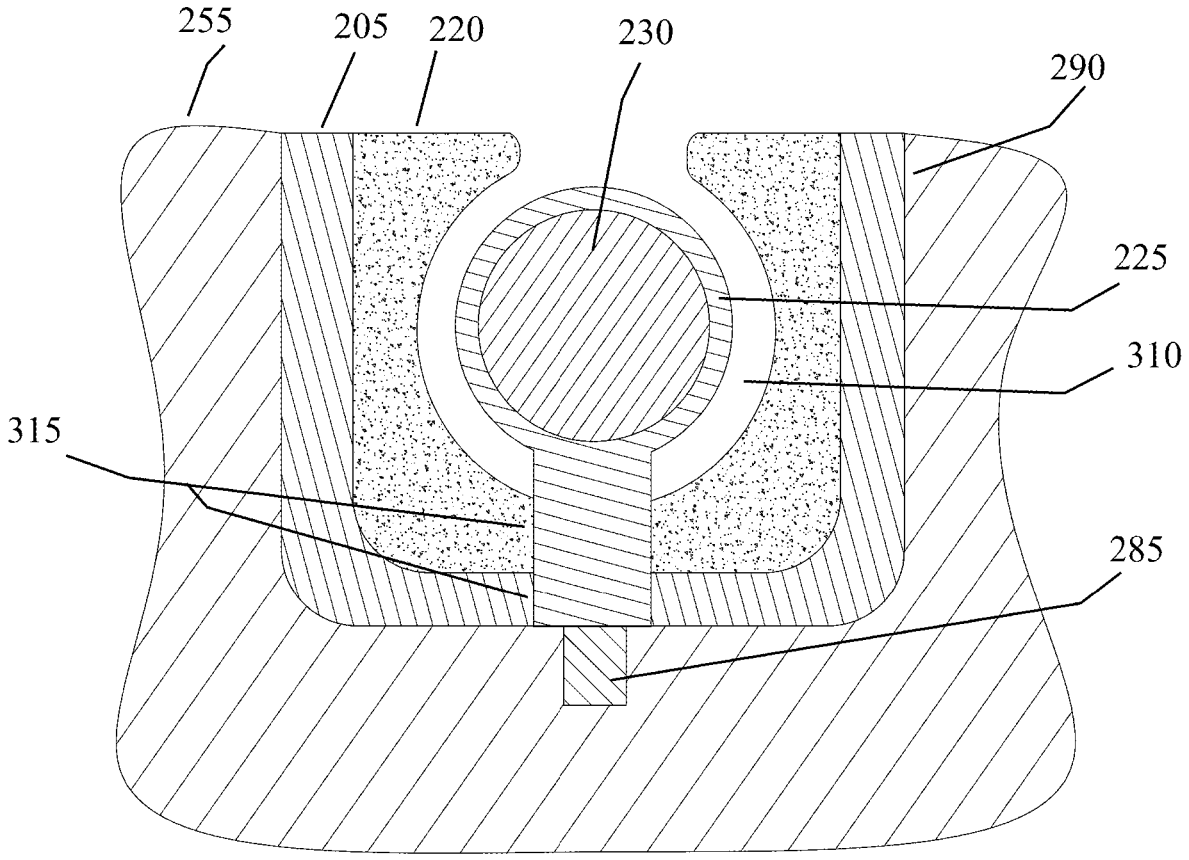
FIG. 2 is a cross-section diagram of the modifications presented in this application.
Figure 3:
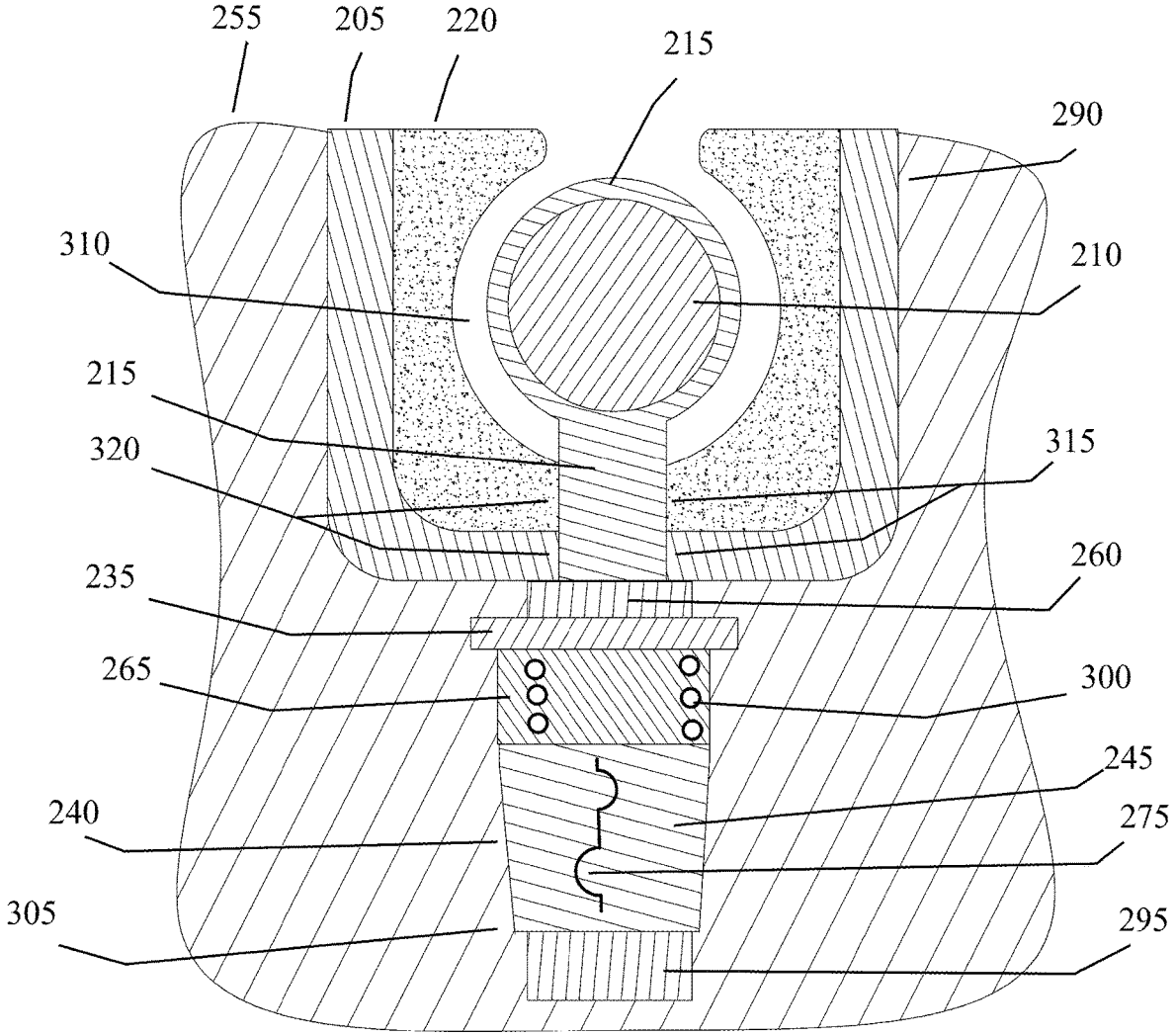
FIG. 3 is a cross-section diagram of the modifications presented in this application.

The coupler FIG. 1-3 may comprise an annular housing 205, like a steel ring or a polymeric block, that may be disposed within the annular groove 290. The annular housing 205 may comprise one or more perforations 315. The perforations may be aligned with the passageway 250 in the annular groove 290 when the housing 205 is installed into the annular groove 290.

An annular magnetically conductive and electrically insulating (MCEI) trough 220 or channel comprising one or more perforations 315 may be disposed within the annular housing 215. The MCEI trough 220 may comprise a plurality of segments 220. For example, a segment may comprise one or two perforations 315. At least one of the perforations 315 in the MCEI trough 220 may be aligned with one of the perforations 315 in the annular housing 205, producing a passageway 320 between the MCEI trough 220 and the drilled passageway 250 in the body of the downhole tool.

An annular electrically conductive wire coil 325 may be laid within the annular MCEI trough 220. The coil 325 may comprise one or more turns. The coil 325 may comprise a linear coil or a nonlinear coil such as a helical coil. The coil 325 may comprise an electrically groundable end 230 and a data or power transmission end 210. The groundable end 230 may be connected to a ground post 285 installed in the tool body 255. The ground post 285 may be aligned with a first perforation 315 in the housing and a first perforation 315 in the MCEI trough 220, thereby electrically grounding the coil 230 to the downhole tool body 255. The data and power transmission end 210 of the coil 325 may be connected through a second perforation 315 in the annular housing and the second perforation 315 in the MCEI trough to a cable 260 within a downhole tool 255 or to a coaxial cable 260 running within the drilled passageway 250 in the downhole tool body 255. The coaxial cable 260 in the drilled passageway 250 may be connected to a transmission end 210 of an annular coil 325 in a similarly configured annular groove 290 and through a similarly configured annular housing 205 and annular MCEI trough 220 at the opposite end of the downhole tool. The cable 260 may comprise a coaxial cable, a twisted pair of wires, or an insulated conductor. The coaxial cable 260 may comprise an armored cable comprising a stainless steel sheath or tube 295. The cable 260 may comprise a nonmagnetic or a magnetic stainless steel tube 295. The cable 260 may be connected to the transmission end 210 of the coil 325 and to equipment within or attached to the downhole tool. The coil's ends 210 and 230 may be connected to the cable 260 and the ground post 285 using a compression connector 215 and 225. The coil 325 may be embedded in a nonelectrically conducting filler material in the core 310 or interior of the MCEI trough 220.

A cylindrical clamp 245 may fix the cable 260 in the drilled passageway 250 proximate the annular groove 290. The clamp 245 may be a cylindrical clamp 245 comprising a passageway through which the cable 260 may pass. The clamp 245 may comprise a slit 275. The slit 275 may be a linear or nonlinear slit 275 and may have an opening wider at the distal end of the clamp 245 than at the proximal end of the clamp 245. The slit 275 may allow the clamp 245 to compress against the inside wall of the drilled passageway 250 and the outside wall of the cable 260, thereby securing the cable 260 in the passageway 250. In downhole use, pipes making up a drillstring hung from a drill rig may elongate as the weight of the drillstring increases with length. The cable 260 clamped at both ends of the drill pipe should be capable of tolerating such elongation forces, tension, acting on the drillstring components downhole without damage to its internal components. The cable's stainless steel tube 295 and the internal components of the cable 260, the center conductor and dielectric, must also be able tolerate drill pipe elongation or stretch. To counteract such forces, the cable 260 and the internal components may be compressed within the stainless steel tube 295 sufficiently that under normal conditions the compressed condition of the cable 260 permits the cable 260 and its components to stretch or elongate along with the drill pipes in the string. The compressed condition of the cable 260 protects the cable 260 from the elongation forces otherwise acting on each individual drill pipe or other tools making up the drill string. The clamp 245 may be positioned in an enlarged portion 240 of the drilled passageway 250. The enlarged portion 240 adjacent the clamp 245 may be tapered matching the tapered portion 245 of the clamp. The clamp 245 may be set on a shoulder 305 within the drilled passageway 250. As the clamp 245 is positioned in the enlarged tapered portion 240 of the drilled passageway 250, the slit 275 allows the clamp 245 to compress against the tapered wall 240 of the drilled passageway 250 and against the outside wall of the cable 260. The clamping force thus created should be sufficient to maintain the compressed condition of the cable 260 as the drill string increases in length and drilling continues downhole.

A gasket 265 may seal off the drilled passageway 250 within the downhole tool body 255. The gasket 265 may be located between the clamp 245 and the annular groove 290 in the downhole tool. The gasket 265 may be a reinforced gasket 265. The reinforced gasket 265 may comprise internal reinforcement such as a helical spring 300 or a leaf spring 270 or other reinforcements. The spring 270, 300 may comprise a metal or a nonmetal sufficiently resilient to contribute additional compressive force to the gasket 265. The gasket 265 may comprise a passageway through which the cable 260 may pass. The gasket 265 may seal the outside wall of the cable 260 against the inside wall of the passageway 250. The gasket 265 may also seal the outside wall of the gasket 265 against the inside wall of the drilled passageway 250. Thereby, the gasket 265 may seal off the drilled passageway 280/250 and the annular groove 290 from the fluids and pressures encountered downhole. The gasket 265 may comprise a material suitable to withstand the harsh conditions downhole. A helical snap ring 235 may be disposed in the drilled passageway 250 between the gasket 265 and the annular groove 290. The snap ring 235 may fix the gasket 265 in place in the drilled passageway 250/280.

The housing 205 may comprise a downhole-suitable polymeric block comprising polyester ether ketone (PEEK), polytetrafluoroethylene (PTFE) (TEFLON), or polyoxymethylene (Delrin), or a combination thereof, comprising up to 67% by volume of micron and submicron particles of Fe and Mn ranging in average diameters of between 150μ and 3000μ in an average ratio of between 8:2 and 2:8, respectively. When electrified, the coupler FIGS. 1-3 comprising the annular coil 325 may produce an electromagnetic field in the MCEI trough 220 suitable for transmission of data and power to an adjacent similarly configured coupler FIGS. 1-3 comprising an MCEI trough 220 and coil 325. The MCEI trough 220 may direct the electromagnetic field to the adjacent MCEI trough 220 in connected drill pipes. But the connection is not leakproof, that is a portion of the electromagnetic field surrounding the coil 325 may leak out into the surrounding steel 255 of the drill pipe and stray electromagnetic fields originating in the drill pipe and outside of the drill pipe may interfere with the transmission between couplers. The presence of the Fe and Mn particles in the block may provide an additional barrier preventing the leakage of the electromagnetic field created by the annular coil 325 and preventing electronic and magnetic interference from the surrounding environment thereby increasing the efficiency of the coupling.

The following descriptions relating to the prior art figures are taken from the '498 and '802 references and are applicable to FIGS. 1-3 except where modified by this application.

Referring to the drawings, (Prior Art) FIG. 4 is a perspective view of a section of drill pipe with cutaway sections showing the data transmission system of the present invention. The most preferred application of the connector is in the data transmission system in sections of drill pipe, which make up a drill string used in oil and gas or geothermal exploration.

The depicted section 15 of (Prior Art) FIG. 4 includes a pin end 13, having external tapered threads 19 (see (Prior Art) FIG. 5), and a box end 11, having internal tapered threads 21 (see (Prior Art) FIG. 6). Between the pin end 13 and box end 11 is the body of the section. A typical length of the body is between 30 and 90 feet. Drill strings in oil and gas production can extend as long as 20,000 feet, which means that as many as 700 sections of drill pipe and downhole tools can be used in the drill string.

There are several designs for the pin and box end of drill pipe. At present, the most preferred design to use with the present invention is that which is described in U.S. Pat. No. 5,908,212 to Grant Prideco, Inc. of Woodlands, Tex., the entire disclosure of which is incorporated herein by reference. As shown in (Prior Art) FIG. 5, the pin end 13 includes an external, primary shoulder 37, and an internal, secondary shoulder or face 35. As shown in (Prior Art) FIG. 6, the box end 11 includes an external, primary shoulder 38 and an internal, secondary shoulder or face 36. As shown in (Prior Art) FIG. 7, when two sections of drill pipe are connected, the pin end 13 is threaded into the box end 11 with sufficient force so that the primary external shoulder 37 on the pin end engages the primary shoulder face 38 on the box end. As a result of this connection being indexed by the primary shoulder 37 and the primary shoulder face 38, the face 35 on the pin end is reliably brought into close proximity or contact with the shoulder 36 on the box end. The advantages this provides to the present invention will be discussed below.

As shown in (Prior Art) FIG. 5, the pin end 13 preferably includes a recess 32 in the secondary or internal shoulder or face 35. Preferably, the recess is located so as to lie equidistant between the inner and outer diameter of the secondary shoulder or face 35. Alternatively, the recess is formed at either the inner or the outer diameter of the face, thereby creating a recess that is open on two sides.

Preferably, the recess is machined into the face by conventional tools either before or after the tool joint is attached to the pipe. The dimensions of the recess can be varied depending on various factors. For one thing, it is desirable to form the recess in a location and with a size that will not interfere with the mechanical strength of the pin end. Further, in this orientation, the recesses are located so as to be substantially aligned as the joint is made up. Other factors will be discussed below.

As can be seen in these figures, the recess is preferably configured so as to open axially, that is, in a direction parallel to the length of the drill string. However, in alternative embodiments, the recesses may be configured so as to open radially, that is, in a direction perpendicular to the length of the drill string. This offset configuration does not materially affect the performance of the inductive elements of the present invention whether in an axial or radial configuration.

Referring to (Prior Art) FIGS. 4, 5, and 6, lying within the recesses 32 and 34 formed in the internal pin face 35 and internal shoulder face 36 respectively is a communication element. As will be discussed below, the preferred communication element is an inductive coil. However, other communication elements, such as acoustic transceivers, optic fiber couplers and electrical contacts are also benefited by being placed in a recess formed in the internal pin face and internal shoulder face. In particular, placing the communication elements in recesses within internal faces provides for better protection from the harsh drilling environment. Also, when using a pipe joint such as that shown in (Prior Art) FIG. 7 that also includes external abutting faces 37 and 38, the internal faces 35 and 36 are brought together in a more reliable manner. That is, with the primary load taken by the external faces 37 and 38, the internal faces 35 and 36 are brought together with a more consistent force. Preferably, the internal faces are less than about 0.03" apart when the adjacent components are fully threaded together. More preferably, the internal faces are touching. Most preferably, the internal faces are in a state of compression.

Returning to a discussion of the preferred embodiment with inductive coils as the communication elements, it is noted that a typical drill pipe alloy, 4140 alloy steel, having a Rockwell C hardness of 30 to 35, has a magnetic permeability of about 42. The magnetic permeability of a material is defined as the ratio of the magnetic flux density B established within a material divided by the magnetic field strength H of the magnetizing field. It is usually expressed as a dimensionless quantity relative to that of air (or a vacuum). It is preferable to close the magnetic path that couples the adjacent coils with a material having a magnetic permeability higher than the steel. However, if the magnetic material is itself electrically conducting, then it provides an alternate electrical path to that offered by the adjacent loops. The currents thus generated are referred to as eddy currents; these are believed to be the primary source of the losses experienced in prior-art transformer schemes. Since the magnetic field is in a direction curling around the conductors, there is no need for magnetic continuity in the direction of the loop.

In the preferred embodiment illustrated in (Prior Art) FIGS. 5, 6 and 14, there is located within the recess 32 a communication element 90 and within the recess 34 an identical communication element 92. In the preferred embodiment, the communication element consists of a steel ring 45 containing a magnetically conducting, electrically insulating (MCEI) element 89, and a conductive coil 87 lying within the MCEI element.

One property of the MCEI element is that it is magnetically conducting. One measure of this property is referred to as the magnetic permeability discussed above. In general, the magnetically conducting component should have a magnetic permeability greater than air. Materials having too high of a magnetic permeability tend to have hysteresis losses associated with reversal of the magnetic domains themselves. Accordingly, a material is desired having a permeability sufficiently high to keep the field out of the steel and yet sufficiently low to minimize losses due to magnetic hysteresis. Preferably, the magnetic permeability of the MCEI element should be greater than that of steel, which is typically about 40 times that of air, more preferably greater than about 100 times that of air. Preferably, the magnetic permeability is less than about 2,000. More preferably, the MCEI element has a magnetic permeability less than about 800. Most preferably, the MCEI element has a magnetic permeability of about 125.

In order to avoid or reduce the eddy currents discussed above, the MCEI is preferably electrically insulating as well as magnetically conductive. Preferably, the MCEI element has an electrical resistivity greater than that of steel, which is typically about 12 micro-ohm cm. Most preferably, the MCEI has an electrical resistivity greater than about one million ohm-cm.

The MCEI element 89 is preferably made from a single material, which itself has the properties of being magnetically conductive and electrically insulating. A particularly preferred material is ferrite. Ferrite is described in the on-line edition of the Encyclopedia Britannica as "a ceramic-like material with magnetic properties that are useful in many types of electronic devices. Ferrites are hard, brittle, iron-containing, and generally gray or black and are polycrystalline—i.e., made up of a large number of small crystals. They are composed of iron oxide and one or more other metals in chemical combination." The article on ferrite goes on to say that a "ferrite is formed by the reaction of ferric oxide (iron oxide or rust) with any of a number of other metals, including magnesium, aluminum, barium, manganese, copper, nickel, cobalt, or even iron itself." Finally, the article states that the "most important properties of ferrites include high magnetic permeability and high electrical resistance." Consequently, some form of ferrite is ideal for the MCEI element in the present invention. Most preferably, the ferrite is one commercially available from Fair-Rite Products Corp., Wallkill, N.Y., grade 61, having a magnetic permeability of about 125. Another preferred commercial supplier of ferrite is Gascyl Ent., Coquitlan, B.C., Canada. There are a number of other manufacturers that provide commercial products having a corresponding grade and permeability albeit under different designations.

As an alternative to using a single material that is both magnetically conductive and electrically insulating, the MCEI element can be made from a combination of materials selected and configured to give these properties to the element as a whole. For example, the element can be made from a matrix of particles of one material that is magnetically conductive and particles of another material that is electrically insulating, wherein the matrix is designed so as to prevent the conduction of electrical currents, while promoting the conduction of a magnetic current. One such material, composed of ferromagnetic metal particles molded in a polymer matrix, is known in the art as "powdered iron." Also, instead of a matrix, the MCEI element may be formed from laminations of a material such as a silicon transformer steel separated by an electrically insulating material, such as a ceramic, mineral (mica), or a polymer. Because the induced electric field is always perpendicular to the magnetic field, the chief requirement for the MCEI element is that the magnetic field be accommodated in a direction that wraps around the coil, whereas electrical conduction should be blocked in the circumferential direction, perpendicular to the magnetic field and parallel to the coil.

In a more preferred embodiment shown in (Prior Art) FIGS. 14 and 14A, the communication element 91 contains an MCEI element. The MCEI element is formed from several segments of ferrite 83 which are held together in the appropriate configuration by means of a resilient material, such as an epoxy, a natural rubber, polytetrafluoroethylene (PTFE), perfluoroalkoxy (PFA), a fiberglass or carbon fiber composite, or a polyurethane. A preferred method of forming a segmented MCEI element begins with providing a steel ring 45 having a generally u-shaped trough conforming to the final dimensions of the MCEI element. In a preferred embodiment, the steel ring 45 has ridges 99 around its circumference in order to enhance the connection of the steel ring to the drill pipe.

The element 99 is preferably manufactured as a complete unit and is then inserted into the drill pipe, the final assembly configuration being shown in (Prior Art) FIGS. 11, 12, and 13. To manufacture the element 99, a two-part, heat-curable epoxy formulation is mixed in a centrifuge cup. If the ferrite elements have some porosity, they can be sealed by being centrifuged for up to 30 minutes to cause all bubbles induced by mixing to rise out of the viscous liquid, and to cause the liquid to penetrate and seal any porosity in the ferrite. Most preferably, a grade of ferrite is used which has very low porosity which does not require sealing in this fashion. The individual u-shaped ferrite segments are then placed in the metal ring, except for a gap surrounding the retaining bridge 43, as shown in (Prior Art) FIGS. 15 and 17.) Any excess epoxy is wiped out of the u-shaped groove. The upper surfaces of the parts can be precisely aligned with each other by holding them in position with magnets placed around the u-shaped trough in the mold. The epoxy is then cured, either at room temperature or in an oven.

The entire communication element 91, including the retaining bridge 43 and the wire 41, may be preassembled before the communication element 91 is inserted in the drill pipe, which can optionally be done in the field. The steel ring 45 has the advantage that it provides a durable frame upon which to house the relatively fragile MCEI. The communication element 91 may be retained in the recess 32 of (Prior Art) FIG. 5 by means of a polymeric bonding material, preferably epoxy, polyurethane, polytetrafluoroethylene, or perfluoroalkoxy, most preferably epoxy. Most preferably, the communication element 91 is retained in recess 32 by means of a press fit.

As seen in (Prior Art) FIGS. 14 and 14A, the communication element 91 preferably comprises a steel ring 45, an MCEI element, and a conductive coil 87. Lying within the trough 83 of the MCEI element 89 is the electrically conductive coil 87. This coil is preferably made from at least one loop of an insulated wire, most preferably only a single loop. The wire is preferably made of copper, most preferably of silver-plated copper-clad steel, and is and insulated with varnish, enamel, or a polymer. Most preferably, the wire is insulated with a tough, flexible polymer such as high density polyethylene or polymerized tetrafluoroethane (PTFE). The diameter of the wire, with insulation, is preferably selected so as to be slightly less than the width of the U-shaped trough 83 in the MCEI element. As will be discussed below, the specific properties of the wire and the number of loops is important in providing proper impedance for the coil 87.

As shown in (Prior Art) FIGS. 14 and 17, the communication element 91 has a first and second contact for connecting to the coaxial cable 51. The first contact is preferably one end of the coil 87. The first contact is preferably retained in the communication element by a retention bridge 43. The retention bridge 43 is preferably inserted in a hole in the steel ring 45, holding the first contact in place and preventing the first contact from coming into electrical contact with the second contact. The retention bridge 43 is made from an electrically insulating material, preferably PTFE, more preferably PEEK®. PEEK® is a trademark for a linear aromatic, semi-crystalline, polyetheretherketone thermoplastic polymer manufactured by Victrex PLC. A typical supplier for such material is Zeus Products, Orangeburg, S.C. The second contact of the communication element 91 is in electrical contact with the steel ring 45, preferably by means of a welded connection 85.

For a given application, the transformer diameter is fixed by the diameter of the pipe. The impedance of the transformer, and its desired operating frequency, can be adjusted by two factors: the number of turns in the conductor and the ratio of length to area of the magnetic path, which curls around the conductors. Increasing the number of turns decreases the operating frequency and increases the impedance. Lengthening the magnetic path, or making it narrower, also decreases the operating frequency and increases the impedance. This is accomplished by increasing the depth of the U-shaped trough or by decreasing the thickness of the side-walls. Adjusting the number of turns gives a large increment, while adjusting the dimensions of the trough enables small increments. Accordingly, the invention allows the impedance of the transformer portion of the transmission line to be precisely matched to that of the conductor portion, which is typically in the range of 30 to 120 ohms. Although an insulated copper wire is preferred, other electrically conductive materials, such as silver or copper-coated steel, can be used to form the coil 87.

As can be seen in (Prior Art) FIG. 14, in a preferred embodiment the coil 87 is embedded within a material which fills the space within the trough of the MCEI element 89. Naturally, this material should be electrically insulating. It is also preferable that this material is resilient so as to add further toughness to the MCEI element. The preferred material to use for this purpose is a two-part epoxy formulation, preferably one filled with a powdered material such as fumed silica or fine aluminum oxide to provide abrasion resistance. The applicants have used standard commercial grade epoxy combined with a ceramic filler material, such as aluminum oxide, in proportions of about 50/50 percent. Other proportions may be desirable, but the filler material should not be less than 3 percent nor greater than 90 percent in order to achieve suitable abrasion resistance as well as adequate adhesiveness. Alternatively, other materials, such as room-temperature curable urethanes, are used. It is important that the material be able to withstand the extreme conditions found downhole. Consequently, it is important to treat the material in such a way as to ensure the absence of voids or air pockets.

As can be seen in (Prior Art) FIG. 7, the box end 11 also includes a recess 34 similar to the recess 32 in the pin end, except that the recess 34 is formed in the internal, secondary shoulder 36 of the box end. A communication element 92, similar in all respects to the communication element 90, is located within the recess 34.

As can be seen in (Prior Art) FIGS. 7, 8A, 8B, and 8C, when the pin and box end are joined, the communication element 90 of the pin end and the communication element 92 of the box end are brought to at least close proximity. Preferably, the elements 90 and 92 are within about 0.5 mm of each other, more preferably within about 0.25 mm of each other. Most preferably, the elements 90 and 92 are in contact with each other. (Prior Art) FIG. 8A is an enlarged cross-section of a connection between communication elements 90, 92 of a connected pin and box end. (Prior Art) FIG. 8B is an enlarged cross-section of a connection between communication elements 90, 92 of a connected pin and box end, showing the protective bridge 43 on the pin end. (Prior Art) FIG. 8C is an enlarged cross-section of a connection between communication elements 90, 92 of a connected pin and box end, showing the protective bridge 43 on the box end.

Because the faces 35 and 36 of the pin and box end may need to be machined in the field after extended use, it may be preferred to design the troughs in the pin and box end with a shape and size so as to allow the first and second conductive coils to lie in the bottom of the respective troughs and still be separated a distance from the top of the respective first and second sides. As a result, the faces 35 and 36 can be machined without damaging the coils lying at the bottom of the troughs. In this embodiment, this distance is preferably at least about 0.01 inches, more preferably, this distance is at least about 0.06 inches.

Turning to (Prior Art) FIGS. 5 and 8, the passages 23 and 25 are holes, preferably drilled from one point in the bottom of the recess 32 and 34, respectively, through the enlarged wall of the pin end and box end, respectively, so that the holes open into the central bore of the pipe section 15. The diameter of the hole will be determined by the thickness available in the particular joint. For reasons of structural integrity it is preferably less than about one half of the wall thickness. Preferably, these holes have a diameter of about between 3 and 7 mm. As can be seen from (Prior Art) FIGS. 5, 8, and 11, the diameter of the passages 23 and 25 preferably increases slightly towards the pin recess 32 and the box recess 34. These larger diameter sections towards the pin recess 32 and the box recess 34 are called the pin connector channel 31 and the box connector channel 33.

These two holes can be drilled by conventional means. Preferably, they are drilled by a technique known as gun drilling. Preferably, the recesses can be machined and the holes can be drilled in the field, so as to allow for retrofitting of existing drill pipe sections with the data transmission system of the present invention in the field.

A conductive tube 71 is placed within the passages 23 and 25. Preferably, the conductive tube 71 runs almost the entire length of the drill pipe, beginning in the pin end connector channel 31, continuing through the pin end passage 23, passing through the hole 93 to enter the interior of the body of the pipe section, entering hole 95, continuing through the box end passage 25, and ending near the box end connector channel 33. The conductive tube 71 is preferably held in tension after it is inserted in the drill pipe 15 and remains in tension during downhole use. This prevents the conductive tube 71 from moving relative to the passages 23 and 25 during downhole use. The conductive tube is preferably made of metal, more preferably a strong metal, most preferably steel. By "strong metal" it is meant that the metal is relatively resistant to deformation in its normal use state. The metal is preferably stainless steel, most preferably 316 or 316L stainless steel. A preferred supplier of stainless steel is Plymouth Tube, Salisbury, Md.

The elements of a preferred embodiment of the invention, from the communication element to the coaxial cable, are shown in (Prior Art) FIGS. 9 through 13. (Prior Art) FIGS. 10 through 13 are enlarged cross sectional views of (Prior Art) FIG. 9 from right to left, with (Prior Art) FIG. 10 showing an enlarged view of the right end of (Prior Art) FIG. 9, (Prior Art) FIGS. 11 and 12 showing enlarged views of the center, and (Prior Art) FIG. 13 showing an enlarged view of the left side of (Prior Art) FIG. 9.

In a preferred embodiment of the invention, the conductive tube is held in place in each end by means of an expansion plug 61 and a retaining plug 63, as shown in FIGS. 6 and 8. The expansion plug 61 preferably increases in diameter from front 62 to back 64, such that the diameter of the back 64 is larger than the initial inner diameter of the conductive tube 71. The expansion plug 61 has a center opening through which the wire 41 passes and is preferably made of metal, more preferably tool steel, most preferably Viscount 44 steel. Thus, as the expansion plug 61 is inserted in the conductive tube 71, the diameter of the conductive tube 71 is increased. The expansion plug 61 is inserted up to a distance relatively near the transition point 97, where the diameter of the passage 31 or 33 undergoes a change in diameter. The result of this insertion of the expansion plug 61 is that the diameter of the conductive tube 71 is larger on each end, so that the conductive tube 71 is held in place in the passages 31 and 33.

In a preferred embodiment, the expansion plug 61 is held in place by a retaining plug 63, as shown in (Prior Art) FIG. 11. The retaining plug 63 is placed in the conductive tube 71 after the expansion plug 61 and has a center opening through which the wire 41 passes. The retaining plug 63 is made metal, more preferably tool steel, most preferably Viscount 44 steel. In a preferred embodiment, the retaining plug 61 has ridges along its outer diameter to dig into the inner diameter of the conductive tube 71 and hold the expansion plug 61 in place.

After exiting the holes 93 and 95, the conductive tube 71 passes through the interior of the body of the pipe section. In an alternative embodiment, the conductive tube may be insulated from the pipe in order to prevent possible galvanic corrosion. At present, the preferred material with which to insulate the conductive tube 71 is PEEK®.

As shown in (Prior Art) FIGS. 5 and 6, the coaxial cable 51 runs inside the conductive tube 71. As shown in (Prior Art) FIGS. 9 and 13, the coaxial cable 51 has a conductive core 79 surrounded by a dielectric sheath 81. In one embodiment of the invention, the coaxial cable 51 also has a conductive sheath surrounding the dielectric sheath 81 and in electrical contact with the conductive tube 51. The dielectric sheath 81 prevents electrical contact between the coaxial core 79 and the conductive tube 71. As shown in (Prior Art) FIG. 13, in a preferred embodiment, an inner layer of the dielectric sheath 81 is removed from around the conductive core 79 at each end, while leaving the outer layer of the dielectric sheath 81 in place next to the conductive tube 71. This allows insertion of the connector 53 around the conductive core 79 and within the dielectric sheath 81. In another embodiment, a portion of the conductive sheath is removed at both ends to thereby provide clearance for the conductive sleeve 75.

At present, the coaxial cable preferably has a characteristic impedance in the range of about 30 to about 120 ohms, most preferably with a characteristic impedance in the range of 50 to 75 ohms. Because the attenuation of coaxial cable decreases with increasing diameter, the largest diameter compatible with installation in pipe chosen for a particular application should be used. Most preferably the cable has a diameter of about 0.25" or larger. Preferably the shield should provide close to 100% coverage, and the core insulation should be made of a fully-dense polymer having low dielectric loss, most preferably from the family of polytetrafluoroethylene (PTFE) resins, Dupont's Teflon® being one example. A foamed polymer may also be used as the core insulation.

It is preferable to select the electrical properties of the conductor so as to match the impedance of the coils to which it is attached. Preferably, the ratio of the impedance of the electrical conductor to the impedance of the first and second electrically conductive coils is between about 1:2 and 2:1. Most preferably, it is close to 1:1.

The preferred data transmission system provides a relatively broad bandwidth. While not wishing to be bound by any particular theory, it is currently believed that this is accomplished by the low number of turns of the conductor and the low reluctance of the magnetic path, thus producing a surprisingly low mutual inductance for such a large diameter coil. For a two-turn coil with a 4.75-inch diameter, the mutual inductance of the assembled toroid is about 1 micro Henry. With a 50 ohm resistive load, peak signal transmission is at about 4 MHz, and at power transmission extends from about 1 MHz to about 12 MHz. The inductive reactance is about 65 ohms, and the attenuation is only about 0.35 dB per joint, equivalent to power transmission of about 92 percent. In some respect, the communication element is thought to perform as a transmission-line transformer, wherein the coupling between the adjacent coils comprises distributed elements of both capacitance and inductance. Thus, the term "inductive coil" is intended to include both coils that transfer signals via induction as well as those coils that act as a transmission-line transformer. As adjacent segments are assembled, a serial filter is created, which has the effect of reducing the bandwidth. If each individual transformer had a narrow bandwidth, the band-pass of the filter would change as additional segments are added, which would require that each individual element be separately tuned according to its position in the system. Nevertheless, a surprising feature of the invention is that identical segments can be assembled in any arbitrary number of joints while still enabling efficient signal coupling. The 30-joint test described below gave a total attenuation of 37.5 dB (0.018% power transmission), of which 70% was in the coaxial cable itself, which was chosen to have a shield diameter of 0.047 inches. Maximum power transmission was at 4.2 MHz and the bandwidth, at half power, of 2 MHz. Thus a six volt, 90 milliwatt signal resulted in a detected signal, after 30 joints, of 80 mV.

As shown in (Prior Art) FIGS. 9, 12, and 13, in both the pin connector channel 31 and the box connector channel 33 is a connector 53. The connector 53 permits the coaxial cable 51 to transmit an electrical signal to the communication element 91. The connector 53 has a conductive sleeve 75 which fits around the conductive core 79. The connector 53 has an insulative coating 77 to prevent electrical contact between the conductive sleeve 75 and the conductive tube 71. Preferably, the insulative coating is TEFLON®. During assembly, the connector 53 is pushed over the conductive core 79, making electrical contact with it. Preferably the connector 53 makes spring contact with the conductive core 79.

In a preferred embodiment, connector 53 fits around a wire 41, which is in electrical contact with the communication element 91. Most preferably the wire 41 is one end of the conductive coil 87. The wire 41 is preferably made of copper or silver-plated, copper-clad steel. The wire 41 has an insulative coating 59, which is made of varnish, enamel, or a polymer. Most preferably, the insulative coating 59 is a tough, flexible polymer such as high density polyethylene or polymerized tetrafluoroethane (PTFE). Preferably, the insulative coating 59 of the wire 41 is removed on the end of the wire 41 closest to the connector 53, in order to facilitate electrical contact between the conductive sleeve 75 and the wire 41. In a more preferred embodiment, the connector 53 is crimped around the wire 41 in order to ensure good electrical contact between the conductive sleeve 75 and the wire 41.

In one embodiment of the invention, as shown in FIG. 9, a centering insulator 73 is used to help position the connector 53. The centering insulator 73 is funnel-shaped at each end and is made of a dielectric material, preferably PTFE, most preferably PEEK®. The centering insulator 73 is hollow in the center, allowing it to slide around the connector 53 and guide the connector 53 towards the core 79.

In a preferred embodiment of the invention, a water-tight seal 55, as shown in (Prior Art) FIG. 9, is present in both the pin end connector channel 31 and the box end connector channel 33 to protect the connections from the high temperature and high pressure downhole conditions. As shown in (Prior Art) FIG. 11, in a preferred embodiment, a spacer 65 is placed between the retaining plug 63 and the water-tight seal. Most preferably, the spacer 65 is made of fiberglass. In the most preferred embodiment, the seal 55 is located proximate to the retaining plug, as shown in (Prior Art) FIG. 11, and forms a seal between the inner surface of the conductive tube 71 and the outer surface of the wire 41. In one embodiment, the seal comprises at least one O-ring 67 and at least one backup 69. Most preferably, there are at least three O-rings 67 and three backups 69. The O-rings 67 are preferably made of rubber, more preferably fluoroelastomer, most preferably a fluoroelastomer marketed under the trademark AFLAS® VITON®. The backups 69 are preferably made of PEEK® and have a v-shaped indentation around one end. As an O-ring 67 is compressed, it moves into the indentation in the backup 69 and causes the outer diameter of the backup 69 to press against the conductive tube 71 and the inner diameter to press against the wire 41, thus helping to maintain the water-tight seal.

In an alternative embodiment, a water-tight seal is present between the connector 53 and the inner surface of the conductive tube 71. In this embodiment, the seal is provided by at least one circumferential groove on the outside of the connector and at least one gasket fitting therein. Alternate embodiments may protect the connection with a water tight seal in other locations, such as between the coaxial core 79 and the conductive tube 71, between the connector 53 and the conductive tube 71, and between the wire 41 and the connecting channels 31 and 33.

Many types of data sources are important to management of a drilling operation. These include parameters such as hole temperature and pressure, salinity and pH of the drilling mud, magnetic declination and horizontal declination of the bottom-hole assembly, seismic look-ahead information about the surrounding formation, electrical resistivity of the formation, pore pressure of the formation, gamma ray characterization of the formation, and so forth. The high data rate provided by the present invention provides the opportunity for better use of this type of data and for the development of gathering and use of other types of data not presently available.

Preferably, the system will transmit data at a rate of at least 100 bits/second, more preferably, at least 20,000 bits/second, and most preferably, at least about 2,000,000 bits/second.

An advantage of the present invention is that it requires relatively low power and has a relatively high preservation of signal. Thus, the system preferably transmits data through at least 30 components powered only by the varying current supplied to one of the first conductive coils in one of the components. More preferably, the system transmits data through at least 50 components powered only by the varying current supplied to one of the first conductive coils in one of the components.

Preferably, the varying current supplied to the first conductive coil in the one component is driving a varying potential having a peak to peak value of between about 10 mV and about 20 V. Preferably, the power loss between two connected components is less than about 5 percent.

It is anticipated that the transmission line of the invention will typically transmit the information signal a distance of 1,000 to 2,000 feet before the signal is attenuated to the point where it will require amplification. This distance can be increased by sending a stronger signal, with attendant increased power consumption. However, many wells are drilled to depths of up to 20,000 to 30,000 feet, which would necessitate use of repeaters to refurbish the signal. Preferably, the amplifying units are provided in no more than 10 percent of the components in the string of downhole components, more preferably, no more than 3 percent.

Such repeaters can be simple "dumb" repeaters that only increase the amplitude of the signal without any other modification. A simple amplifier, however, will also amplify any noise in the signal. Although the down-hole environment is thought to be relatively free of electrical noise in the RF frequency range preferred by the invention, a digital repeater will provide a fresh signal without amplifying background noise. Most preferably, a "smart" repeater that detects any errors in the data stream and restores the signal, error free, while eliminating baseline noise, is preferred. Any of a number of known digital error correction schemes can be employed in a down-hole network incorporating a "smart" repeater.

Most preferably, the repeater not only serves to regenerate the data stream, but also serves as a data source itself. Prior to the present invention, information was available during drilling only from the bottom-hole assembly, as mud pulse data rates did not allow any intermediate nodes. With the present invention, information is available from any node along the drill string, thereby enabling distributed access to information from top to bottom. For instance, instead of relying on a single bottom hole pressure measurement, a pressure profile can now be generated along the entire drill string. This could be vital in underbalanced drilling, where to speed up drilling the pressure provided by the mud is less than that of the pore pressure in the surrounding formation. Any sudden pressure pulse or "kick" could be much more rapidly anticipated. Other types of data sources for downhole applications are inclinometers, thermocouples, gamma ray detectors, acoustic wave detectors, neutron sensors, pressure transducers, potentiometers, strain gages, seismic sources, and seismic receivers.

It is therefore intended that the foregoing detailed description be regarded as illustrative rather than limiting, and that it be understood that it is the following claims, including all equivalents, that are intended to define the spirit and scope of this invention.

The invention claimed is:

1. A transmission system, comprising:
- a downhole tool comprising an annular groove communicating with a drilled passageway in the downhole tool;
- an annular housing disposed within the annular groove, the annular housing comprising at least first and second perforations;
- an annular magnetically conductive electrically insulating, MCEI, trough disposed within the annular housing, the annular MCEI trough comprising first and second perforations;
- an annular electrically conductive coil laid within the annular MCEI trough;
- the annular electrically conductive coil comprising a groundable end and a transmission end;
- the groundable end being connected to a ground post electrically contacting the downhole tool through the first perforation in the annular housing and the first perforation in the MCEI trough, and wherein
- the transmission end is connected through the second perforation in the annular housing and the second perforation in the MCEI trough to a cable within the drilled passageway in the downhole tool.

2. The transmission system of claim 1, wherein the MCEI trough comprises MCEI segments, at least one of which comprises the first perforation.

3. The transmission system of claim 1, wherein the MCEI trough comprises MCEI segments, at least one of which comprises the second perforation.

4. The transmission system of claim 1, wherein the MCEI trough comprises MCEI segments, at least one of which comprises the first and the second perforations.

5. The transmission system of claim 1, wherein the cable is connected to another transmission end of another annular coil through a similarly configured annular MCEI trough at the opposite end of the downhole tool.

6. The transmission system of claim 1, wherein the cable is connected to another transmission end of another annular coil through a similarly configured annular MCEI trough within the downhole tool.

7. The transmission system of claim 1, wherein the cable is connected to equipment within or attached to the downhole tool.

8. The transmission system of claim 1, wherein the transmission end and the cable are connected by means of a compression connector.

9. The transmission system of claim 1, wherein the groundable end and the ground post are connected by means of compression connector.

10. The transmission system of claim 1, wherein an at least partially axially tapered clamp secures the cable within the downhole tool.

11. The transmission system of claim 10, wherein the tapered clamp comprises a nonlinear slit.

12. The transmission system of claim 10, wherein the tapered clamp holds the cable in sufficient tension to resist elongation of the cable under downhole conditions.

13. The transmission system of claim 1, wherein a reinforced gasket comprising internal resilient reinforcements seals the cable within the downhole tool.

14. The transmission system of claim 13, wherein the reinforced gasket is secured in place by a helical snap ring within the downhole tool.

15. The transmission system of claim 13, wherein the reinforced gasket provides a pressure and fluid seal between the interior of the gasket and the exterior of the cable and between the exterior of the gasket and the interior of the passageway in the downhole tool.

16. The transmission system of claim 1, wherein the housing comprises a downhole-suitable polymeric block comprising up to 67% by volume of micron and submicron particles of Fe and Mn ranging in average diameters of between 150μ and 3000μ in an average ratio of between 8:2 and 2:8 Fe to Mn.

17. The transmission system of claim 1, wherein the groove comprises a surface hardness on the Rockwell C scale greater than the surface hardness of the downhole tool proximate the groove.

18. The transmission system of claim 1, wherein the cable comprises a coaxial cable comprising an armored exterior.

19. The transmission system of claim 1, wherein the cable comprises a coaxial cable comprising an armored exterior comprising a magnetic or a nonmagnetic stainless steel tube.

20. The transmission system of claim 1, wherein the MCEI trough comprises a nonconductive polymeric filler.

* * * * *